US005533729A

United States Patent [19]

Leu

[11] Patent Number: 5,533,729

[45] Date of Patent: Jul. 9, 1996

[54] GOLF CLUB HEAD

[76] Inventor: Paul Leu, No. 41, Lane 115, Shui Yuan Rd., Fong Yen City, Taichung Hsien, Taiwan

[21] Appl. No.: 414,786

[22] Filed: Mar. 31, 1995

[51] Int. Cl.[6] ..... A63B 53/04

[52] U.S. Cl. ..... 473/346

[58] Field of Search ..... 273/167 H, 173, 273/167 J, 174, 167 A, 169, 172

[56] References Cited

U.S. PATENT DOCUMENTS 5,346,217 9/1994 Tsuchiya et al. ..... 273/167 J X

FOREIGN PATENT DOCUMENTS 4367678 12/1992 Japan ..... 273/167 H

*Primary Examiner*—George J. Marlo
*Attorney, Agent, or Firm*—Varndell Legal Group

[57] ABSTRACT

A golf club head including a top cover shell, a bottom shell, and a face plate. The face plate has a heel and a toe at two opposite ends, a neck integrally extended from the heel at an angle for coupling a club shaft, and a plurality of reinforcing ribs raised from a back side thereof. The toe being relatively thicker than the middle part of the face plate so that the toe and said neck are balanced.

1 Claim, 3 Drawing Sheets

GOLF CLUB HEAD

BACKGROUND AND SUMMARY OF THE INVENTION

The present invention relates to golf clubs, and relates more particularly to a golf club head mounting hardware which comprises a top cover shell and a bottom shell made from a respective titanium sheet by a punching process, and a face plate made from a titanium round rod by means of a die forging process and fastened to the top cover shell and the bottom shell by a welding process.

A good golf club head must have a broad face and a light weight, and can strike the ball to a long distance in the controlled direction. Various materials have been developed and used for the fabrication of golf club heads. Among these materials, titamium is most inviting because of its advantages of low specific gravity and high strength. However, because titamium has high melting point and tends to oxidize into an active status under high temperature, it must be melted under a vacuum state while casting. This complicated process greatly increases the cost of the golf club head and has limitations in performance.

The present invention has been accomplished to provide a golf club head mounting hardware which eliminates the aforesaid problems. According to the present invention, the golf club head is made by welding a top cover shell, a bottom shell, and a face plate together. The top cover shell and the bottom shell are made from a respective titamium sheet by a punching process. The face plate is made from a titamium round rod by means of a die forging process, and then welded to the top cover shell and the bottom shell. Furthermore, the face plate has an integral neck for coupling the club shaft, and a plurality of reinforcing ribs at the back side to reinforce the structural strength. The toe of the base plate is relatively thicker than the middle part of the face plate, so that the toe and the neck of the face plate are balanced.

DETAILED DESCRIPTION OF THE PREFERRED EMBODIMENT

Figure 1:
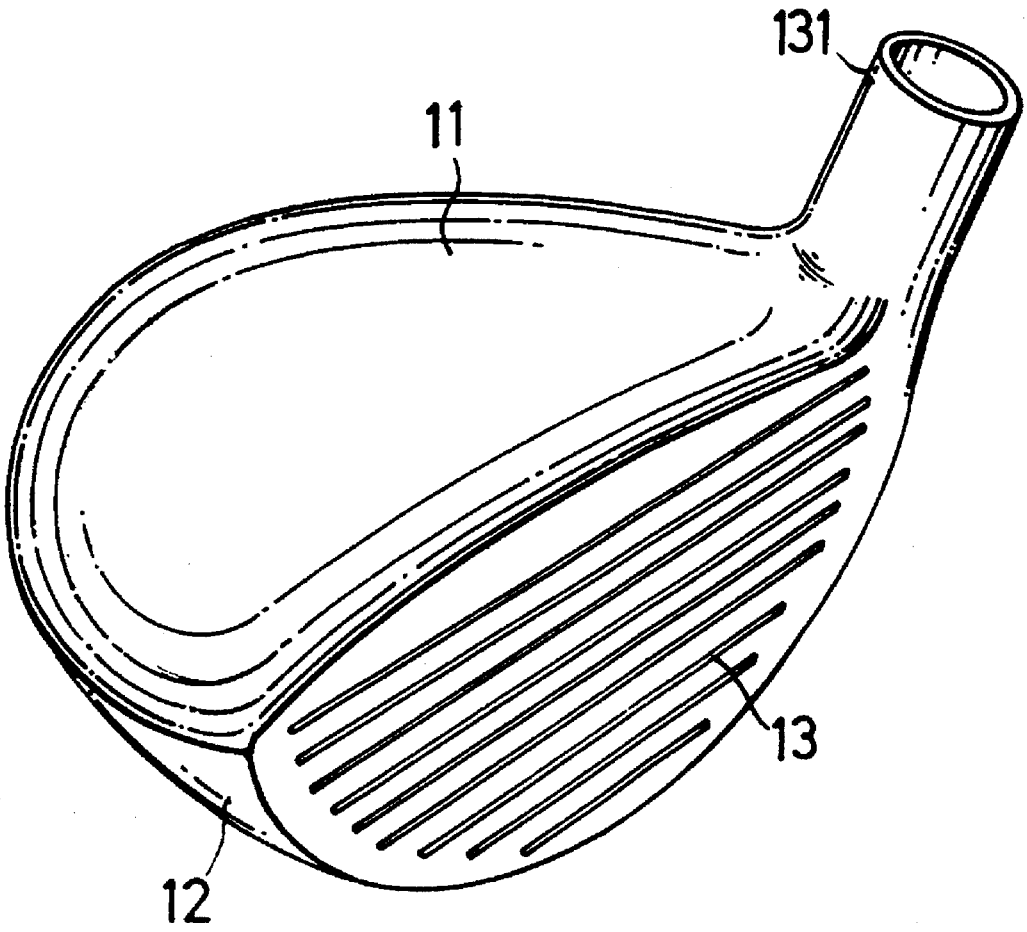
FIG. 1 is an elevational view of a golf club head according to the present invention.
Figure 2:
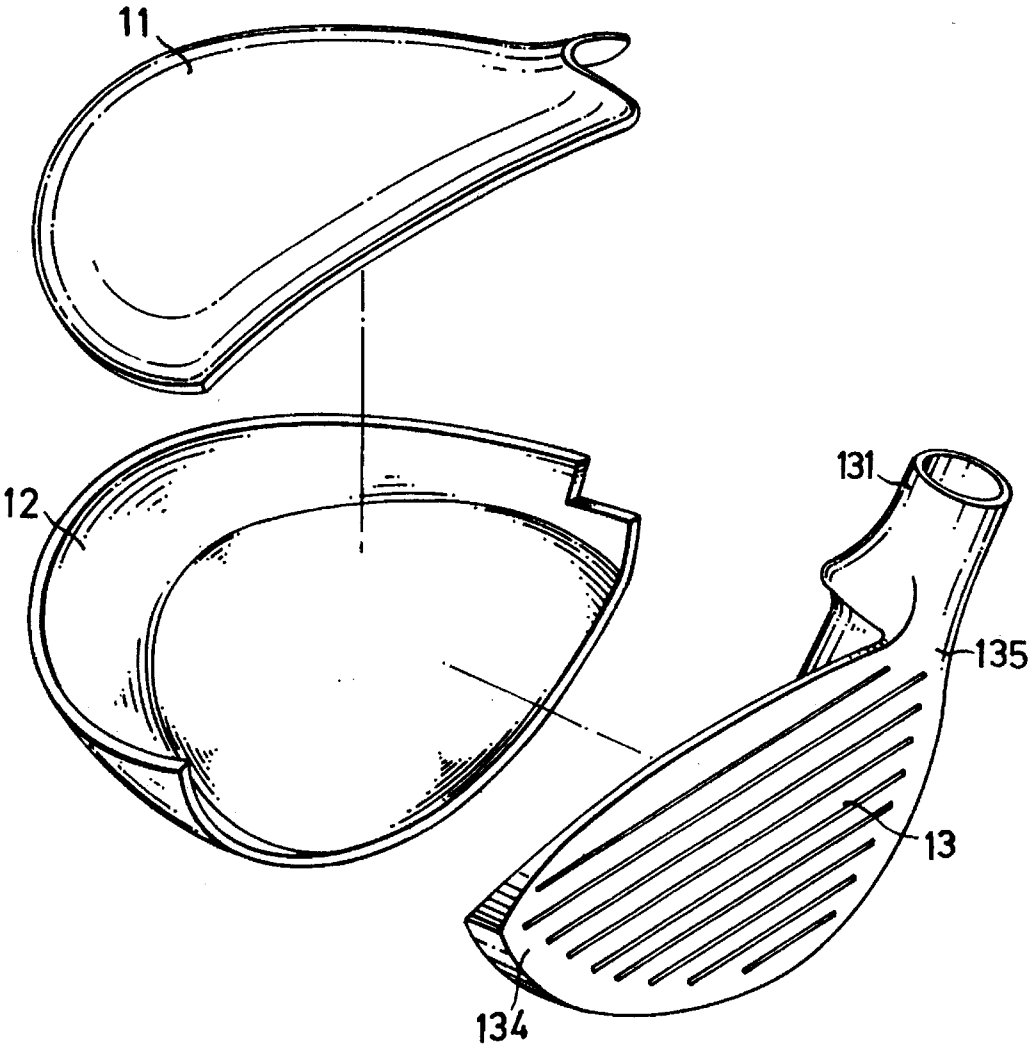
FIG. 2 is an exploded view of the golf club head shown in FIG. 1.
Figure 3:
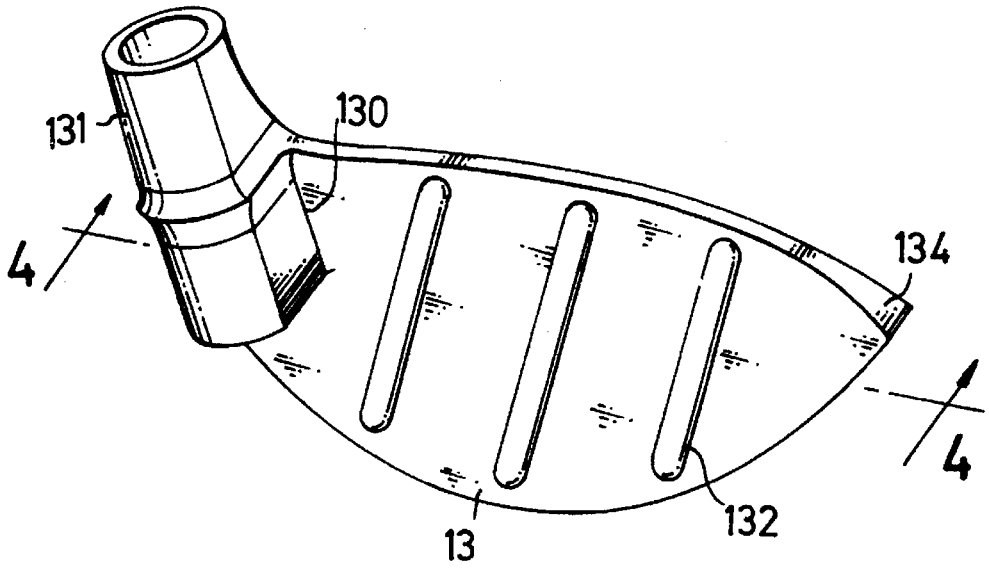
FIG. 3 is a back side view of the face plate shown in FIG. 2.
Figure 4:
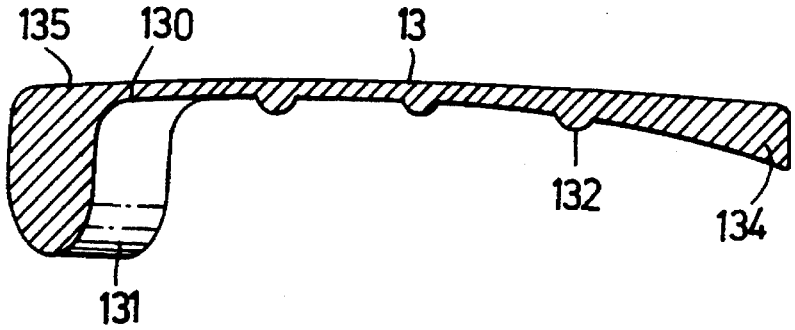
FIG. 4 is a sectional view taken along line 4—4 of FIG. 3.

Referring to FIGS. from 1 to 4, a golf club head 1 in accordance with the present invention is made by welding a top cover shell 11, a bottom shell 12, and a face plate 13 together. The top cover shell 11 and the bottom shell 12 are made from titanium sheet by means of a punching process. The face plate 13 is made from a titamium round rod by a die forging process, having an unitary neck 131 extended from the heel 135 thereof at a turning angle for coupling to the club shaft (not shown). This turning angle eliminates the problem of stress concentration when the face plate 13 is welded to the top cover shell 11 and the bottom shell 12 and coupled to the club shaft. When the face plate 13 bears a strong impact, less pressure is transmitted to the connecting area 130 between the neck 131 and the heel 135, and therefore the neck 131 will not break. The thickness of the toe 134 of the face plate 13 is relatively thicker than the middle part of the base plate 13, and therefore the toe 134 and the neck 131 are maintained balanced. Furthermore, a plurality of reinforcing ribs 132 are raised from the back side of the face plate 13 to reinforce the structural strength of the face plate 13.

I claim:

1. A golf club head comprising a titanium top cover, a titanium bottom shell, and a titanium face plate; said top cover, said bottom shell and said face plate respectively welded together; said face plate having a heel at one end, a toe at another end, a middle between said heel and said toe, a top, a bottom, a back with plurality of reinforcing parallel ribs raised from said back and extending in a direction from said top to said bottom, and a neck integrally formed with said face plate at said heel thereof, said neck arranged along said back and extending from below and to above said top at an angle for holding a club shaft; said toe having a thickness greater than a thickness of said middle for balancing said toe and said neck about said middle.

* * * * *